United States Patent [19]

Juriss et al.

[11] 4,067,159

[45] Jan. 10, 1978

[54] BUILDING CLUSTER OF A PLURALITY OF BUILDING UNITS

[75] Inventors: Ivan Bertram Juriss; Roger Douglas Hay; Andrew Culross Goodfellow; Thomas Townson; Keith Eric Hay, all of Auckland, New Zealand

[73] Assignee: Industrialised Building Systems Limited, New Zealand

[21] Appl. No.: 627,857

[22] Filed: Oct. 31, 1975

Related U.S. Application Data

[63] Continuation of Ser. No. 418,216, Nov. 23, 1973, abandoned.

[30] Foreign Application Priority Data

Nov. 22, 1972 New Zealand ..... 169084

[51] Int. Cl.[2] ..... E04H 1/00

[52] U.S. Cl. ..... 52/234; 52/79.2; 52/285; 52/584

[58] Field of Search ..... 52/285, 287, 79, 586, 52/583, 584, 234, 582, 615, 288

[56] References Cited

U.S. PATENT DOCUMENTS

| | | | |
|---|---|---|---|
| 2,173,808 | 9/1939 | Kellogg | 52/615 |
| 2,218,465 | 10/1940 | Gunnison | 52/406 |
| 2,476,501 | 7/1949 | Maniscalco | 52/582 X |
| 2,621,378 | 12/1952 | Wilson | 52/615 X |
| 2,647,287 | 8/1953 | Jones | 52/754 X |
| 3,103,709 | 9/1963 | Bolt | 52/79 X |
| 3,147,336 | 9/1964 | Mathews | 52/584 X |
| 3,256,663 | 6/1966 | Bishop | 52/288 X |
| 3,300,919 | 1/1967 | Hiller | 52/287 X |
| 3,343,314 | 9/1967 | Smith | 52/584 X |
| 3,387,733 | 6/1968 | Field | 52/285 X |
| 3,392,497 | 7/1968 | Cushman | 52/615 X |
| 3,585,771 | 6/1971 | Pinniger | 52/583 X |
| 3,675,379 | 7/1972 | Lambert et al. | 52/274 X |
| 3,793,789 | 2/1974 | Greenamyer | 52/584 X |

FOREIGN PATENT DOCUMENTS

| | | | |
|---|---|---|---|
| 782,194 | 4/1968 | Canada | 52/79 |
| 914,436 | 8/1946 | France | 52/582 |
| 884,329 | 8/1943 | France | 52/584 |
| 877,467 | 9/1961 | United Kingdom | 52/583 |

*Primary Examiner*—Leslie Braun

[57] ABSTRACT

A building cluster is provided with each building consisting of a stressed skin floor unit, stressed skin roof units and wall panels separating the two, at least some of the wall panels being connected to the roof and floor units by shear resisting brackets. A waterproof covering is provided for each building and the buildings have sufficient excess strength so that wall panels may be removed to allow a great degree of choice in the number and disposition of wall panels which maximize user choice in the disposition of doors and openings from one building into another in the cluster.

11 Claims, 43 Drawing Figures

FIG. 7.
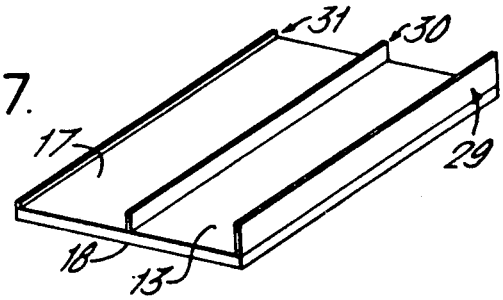
FIG. 8.
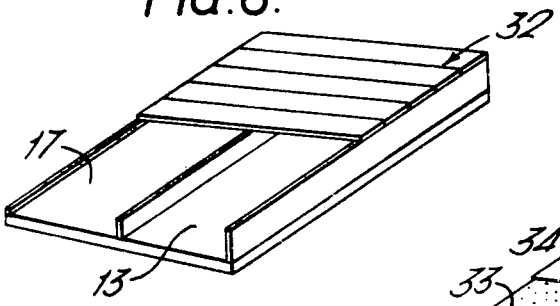
FIG. 9.
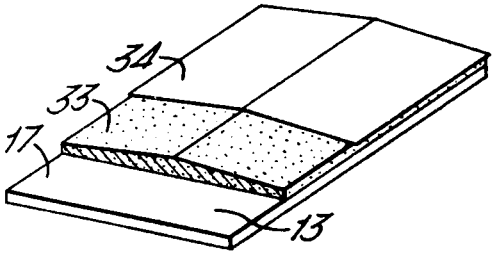
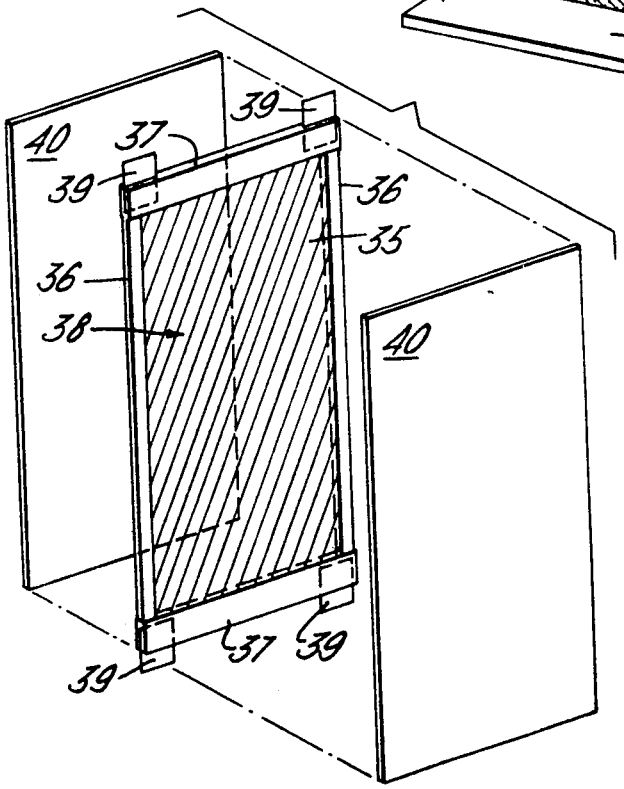
FIG. 10.

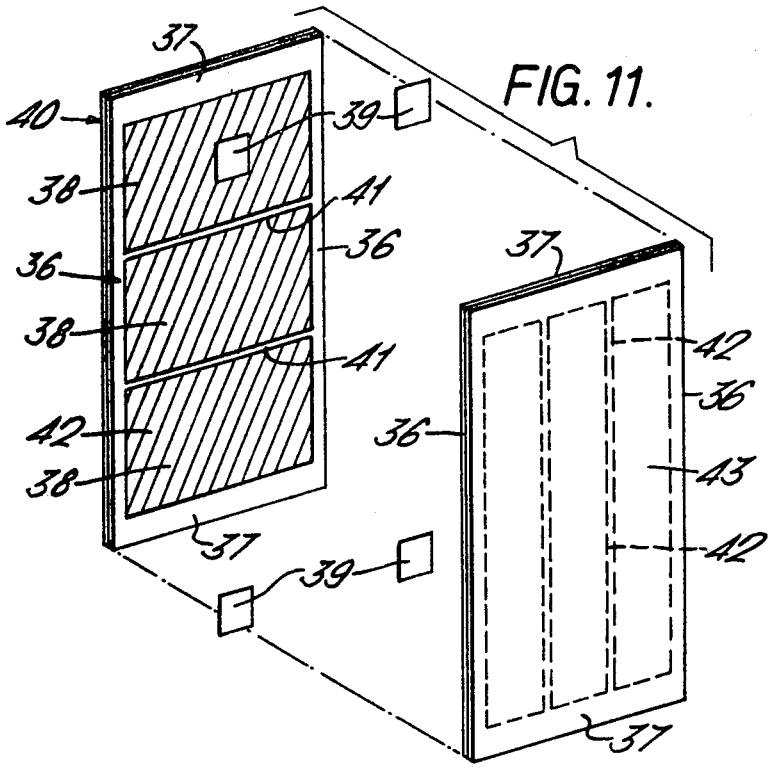
FIG. 11.
FIG. 12.
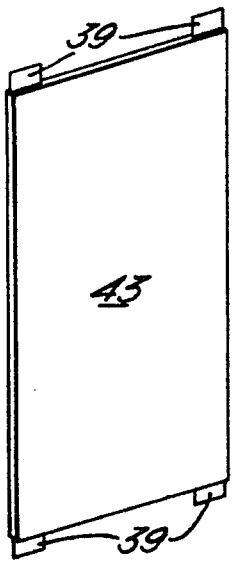
FIG. 13.
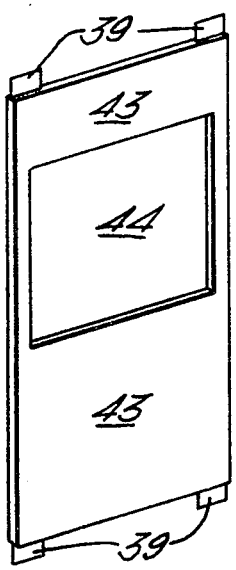
FIG. 14.
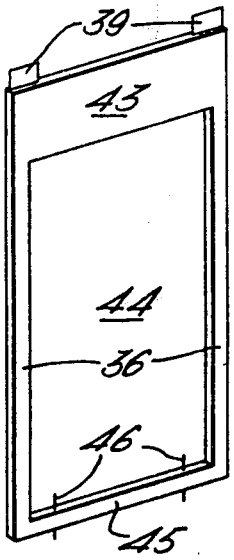

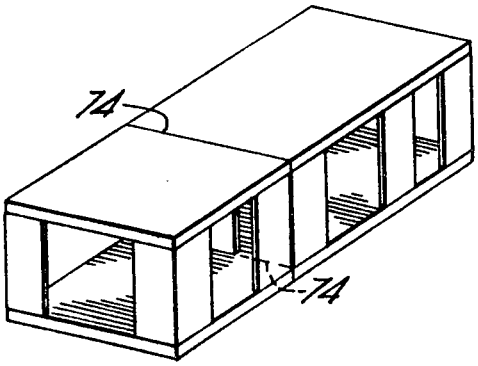
FIG. 27a.
FIG. 28.
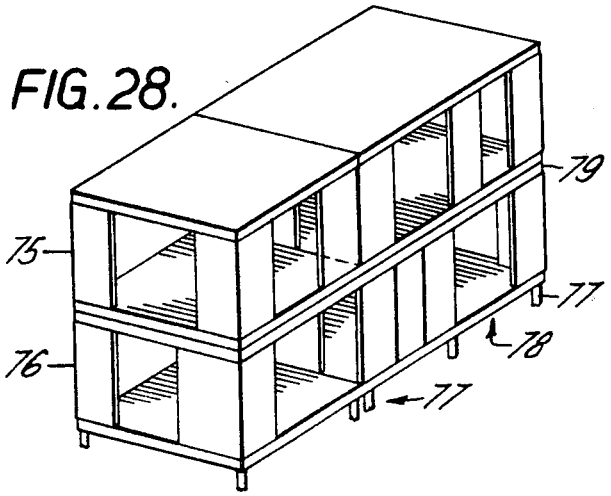
FIG. 29.
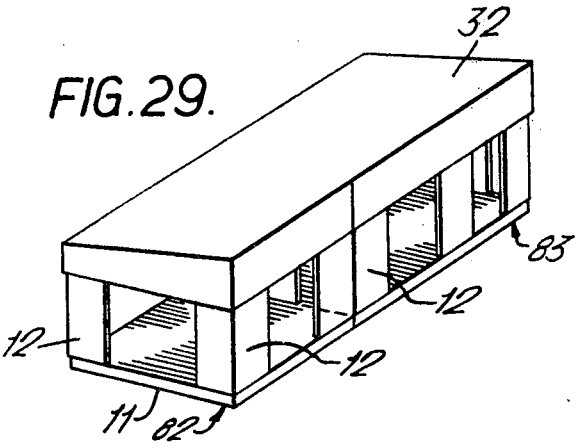

BUILDING CLUSTER OF A PLURALITY OF BUILDING UNITS

This is a continuation of application Ser. No. 418,216 filed Nov. 23, 1973, now abandoned.

BACKGROUND OF THE INVENTION

This invention relates to buildings.

There exists a need for a system of constructing buildings and building clusters which reduces the delay and high costs inherent in erecting a building on unprotected sites by completing the buildings as far as possible entirely inside a factory and transporting the entire building or major completed portions of such a building such as rooms or group of rooms to the eventual site, thereby reducing the time and effort involved on the site to the operations of placing the building or group of rooms or rooms on its or their foundations and making the connection of such services as water, drainage and electricity. Also, it is desirable to reduce the time and skill involved in erecting a building cluster from a large number of small components which are provided in an unfinished or semi-finished state, by making the greatest possible use of the limited number of completely finished components, each capable of manufacture at relatively high speed under controlled conditions in the factory, and all of which are capable of assembly under factory conditions with a minimum of skill.

Still further, it is desirable to reduce the difficulty and cost of altering and removing buildings, including in the changing of position and removal and insertion of doors, windows or walls, the addition or subtraction of rooms or wings of the building, and the shifting of all or any portion of the building from the site on which it was originally erected to any other site, by construction of a building in such a manner that whole or any part of it may be dismantled easily and either removed altogether or replaced with some other part which is compatible with the original.

It is also desirable that the building should be designed to modular design restraints in a manner such that replacement of structural elements is assisted by the modular design and assembly of buildings into a building cluster can also be facilitated by the use of modular design restraints.

OBJECTS AND SUMMARY OF THE INVENTION

It is therefore an object of the present invention to provide a system of building which will meet the foregoing desiderata in a simple yet effective manner or which will at least provide the public with a useful choice.

Accordingly in one aspect the invention consists in a method of constructing a building comprising the steps of constructing structural buildings in a factory each building comprising a room or group of rooms of a selected width or group of widths and convenient length and which buildings may be joined end to end, end to side or side to side within predetermined limitations, transporting said buildings on a transporter to a building site, providing suitable foundations or supports and jointing said buildings end to end, end to side or side to side as desired to provide a building cluster, the construction and arrangement being such that any building or structural unit of said building may be removed from the site for use on another site or returned for disassembly at a factory.

In a still further aspect, the invention consists in a building, cluster comprising one or more buildings each building comprising a room or group of rooms of a selected width or group of widths and of any convenient length and which may be joined end to end, end to side or side to side within predetermined limitations, each said building comprising one or more stressed skin floor units adapted to be fixed to foundation members, wall panel members at least some of which include shear resistant members adapted to resist side sway or lozenging, mounting means mounting said panels on said floor units, connecting means adjacent panels to each other and one or more stressed skin roof units mounted on said wall panels and fixed thereto and the fixing of the panels to the roof and floor units being such as to enable one or more wall panels to be removed without disturbing adjacent wall panels or services to the building.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

One preferred form of the invention will now be described with reference to the accompanying drawings in which,

BRIEF DESCRIPTION OF THE DRAWINGS

FIG. 7 to FIG. 9 show a roof unit with roof supporting members and roof units thereon, FIG. 10 to FIG. 14 and FIG. 15*a* and FIG. 16*a* show wall panels for use in a building construction according to the invention.

FIG. 27*a* and FIG. 28 show assembled single and double storied clusters of buildings, FIG. 29 to FIG. 33 show assembled building clusters

DETAILED DESCRIPTION OF THE INVENTION

Figure 1:
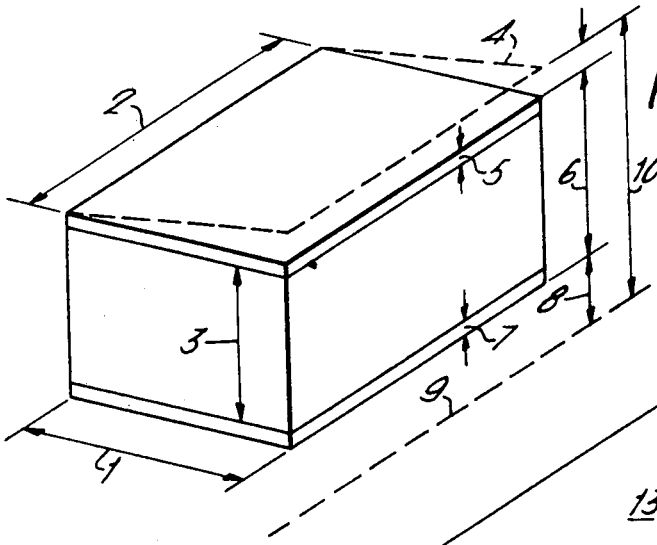
FIG.1 is a diagram showing dimensional criteria of a building according to the invention.

The system consists basically of two units, the first shown in FIG. 1 and the second described later. The first unit consists of a unit of a building comprising a room or group of rooms, in which the width 1 is determined by the combination of the minimum dimension suitable for a room e.g. 2400 mm to 3600 mm or 4000 mm or a room and adjacent corridor e.g. 2700 mm plus 900 mm or 3000 mm plus 1000 mm together with the maximum width permitted for transport without disruption or difficulty e.g. 2400 mm on rail, or up to 3000 mm or more on roads, 3600 mm = 12 feet on New Zealand roads but 4200 mm = 14 feet permitted on some USA roads in which the length 2 is any length suited to the mode of transport without requiring special permission for overlength loads, e.g. 7200 mm = 24 feet on flat bed truck or 10,000 mm = 36 feet on an articulated truck or up to 12,000 mm = 40 feet where international containers can be carried as on rail and in which the height from floor to ceiling is determined by the minimum requirements of building laws e.g. 2400 mm and the maximum height determined by maximum height permitted for transport as follows.

Where any projection of the roof 4 if required to have a slope above the roof structure thickness 5 when added to the total height 6 of the structure, consisting of dimension 3 plus dimension 5 plus the thickness of the floor structure 7 and added to the height 8 of the transporter above the ground line 9 add up to a total dimension 10 which is within the height allowed for transport e.g. 4420 mm = 14 feet 6 inches on roads in New Zealand without specific dispensations, for example, the 14 feet 6 inches height is the New Zealand National Roads Board height for clearance under bridges, but if the route avoids bridges, the operating clearance may be say 18 feet 5400 mm under power lines.

In these terms the desiderata involved in arriving at the invention herein described are:

1. Factory construction: hence transportable to site
   : hence relocatable.
2. Modular (composed of fully compatible, interchangeable units).
   : hence initial choice in arrangement.
3. Demountable (any component can be removed or replaced via accessibility of fixing).
   : hence subsequent choice in arrangement.

Factory construction was desired for a. speed of production
b. economy of production (inventory and management).
c. control of production (uninterrupted production plus quality control).

Modular construction aids this by increasing choice while keeping standardized parts.

Demountability implies ease of assembly, aiding factory construction, as well as ease of on-site alteration.

Figure 2:
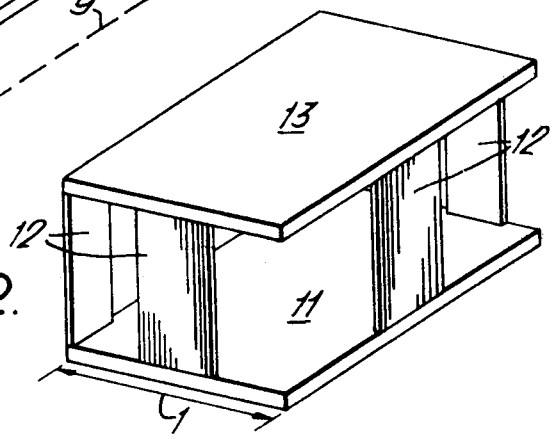
FIG. 2 is a diagrammatic sketch of a pair of stressed skin plates separated from each other by wall panels.

To achieve these, desired units as shown in FIG. 2 are constructed three major elements:

A floor unit 11 which is a stressed skin slab designed to span its width in both directions or any lesser dimension over foundations, load bearing panel units 12 which need not be connected to each other by their vertical edges, and which may be interspersed with either other panel units containing doors or windows or with openings to allow access from one building unit to another, a roof unit 13 which is also a stressed skin slab like the floor unit and also designed to span its width 1 in either direction, so that the maximum spacing between panel units 12 may be dimension 1 at any point.

Figure 3:
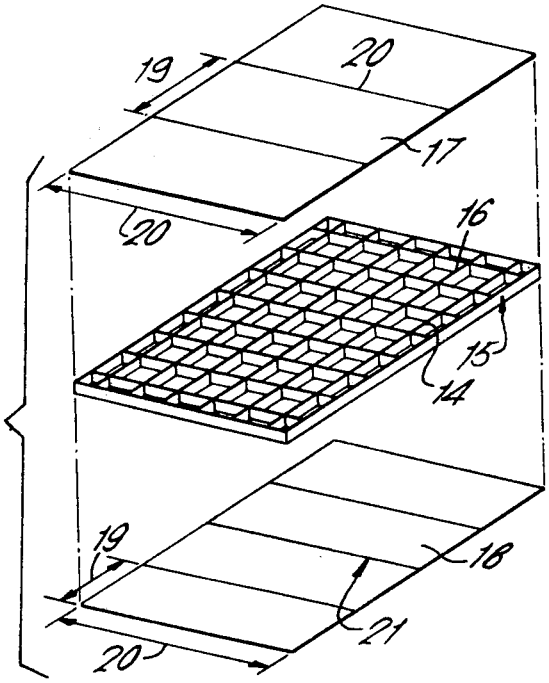
FIG. 3 is an "exploded" view of floor or roof units according to the invention.

The dimensions of the panel units 12 are governed by the height 3 (FIG. 1) with their thickness being not less than 1/50 of that height (structural principle to avoid buckling applied to any column = length over thickness not greater than 1/50) and their width being any convenient width to suit user requirements in planning and to suit manufacturing requirements e.g. 1200 mm max if using panels made of sheet materials made in 1200 mm widths but greater if not so restricted, down to a convenient minimum of 200 mm. The construction of both elements 11 and 13 is basically identical consisting of:

A core 14 (FIG. 3) which in itself is composed of edge members 15 designed to take, in the case of element 11 (floor), the varying positions and amounts of loads imposed by the variable positions of the wall panel units 12 and transmit them to the rent of the slab and thus the slab supports, and a two-way shear web consisting of an interlocking grid e.g. an egg carton or cellular unit of thin members, (not beams or joists), the minimum thickness of which is determined by the buckling ratio of 1/50 in relation to the spacing between grid members and the maximum thickness and height determined by the allowable shear stress of the material used.

An upper skin 17 and a lower skin 18 which both may consist of sheets of rigid material of a length 20 corresponding to the width 1 of the element and a number of widths 19 joined edge to edge at 21 to make up the required size of skin, by any means which effectively enables the skin to span in either direction between the shear webs in the core and take tension or compression stresses in either direction as required by the loads carried or the position of the joints i.e. the position of the joints may mean that there is negligible stress in the joints, or stresses may mean that only some percentage of the full strength of the skin material needs to be transmitted across the joints. Joints may for example be glued feathers, glued scarfs, glued reinforcing plates, glued finger joints, nail plates or other suitable joints.

Figure 4:
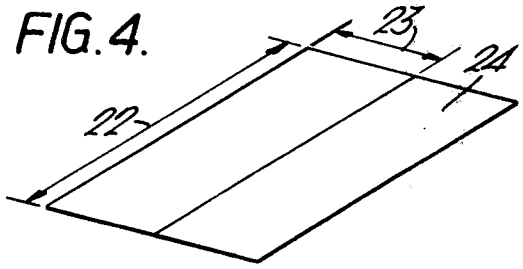
FIG. 4 and FIG. 5 are isometric sketches of different skins for the units shown in FIG. 3.

FIG. 4 shows a skin 24 consisting of sheets whose width 23 is half the width of the element and whose length 22 is that of the element.

Figure 5:
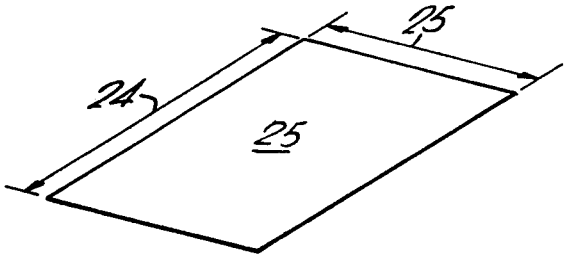

FIG. 5 shows a skin which is made in one piece to the size of the element, with the thickness of the skins being determined by the bending stresses imposed by loads on the spans between the web members 16 and by the buckling ration of 1/50 when the skin is in compression in the span over the web members.

The two skins 17, 18 are glued to the core 14 and consist of any suitable material in which the strength and stability are either equal or nearly equal in both directions of the plane of the material, e.g. plywood, particle board, hardboard and fiber-reinforced materials. The web members and preferably the edge member 15 consist of the same material or similar compatible materials, and the whole element then takes on the dimensional stability under load including loads caused by thermal or hygroscopic expansion and contraction of the materials of which it is composed with modern production techniques. The materials are such that they can be formed or cut with the required degree of accuracy e.g. deviation from straight on any edge of 0.000004% and deviation in length of diagonals of 0.3% and thus the whole element takes on a similar degree of accuracy with a similar degree of dimensional stability so that it attains and retains a dimensional accuracy which is particularly suitable for use in the construction of a building unit in which the facility of joining to other similar units depends on such dimensional accuracy.

Similarly, the use of materials whose strength is equal or nearly equal in both directions combined in the construction of a stressed skin unit with a two-way shear web core, which may be regarded as acting either as a plate or as a two-way slab, depending on the analysis of the loading conditions, produces an element in which the rigidity is equal or nearly equal in both directions which is particularly suitable for use in the construction of a building unit in which the facility of joining to other units depends or may depend on just such a rigidity characteristic.

Figure 6:
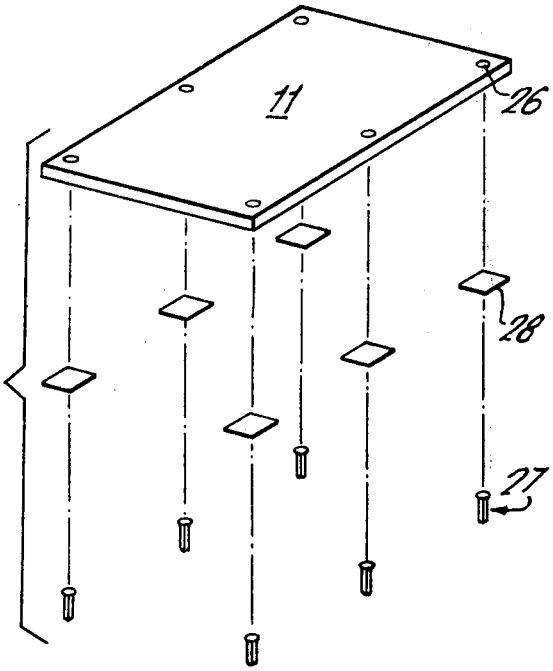
FIG. 6 is an "exploded" view of a floor unit according to FIG. 3 arranged in relation to supports such as foundation piles.

Referring to FIG. 6, element 11 differs from element 13 (FIG. 2) basically in that the upper skin 17 is made from a material particularly chosen for its suitability as a floor surface in terms of appearance and wearing characteristics and for its particular suitability in taking live loads imposed by occupants, furniture, fittings or machinery etc. It also differs from element 13 in that it is specially reinforced at, for example, the points 26 corresponding to the positions of the element supports e.g. foundations 27 but may be support points on the roof of a ground floor unit where element 11 is the floor of the first floor, either by incorporating solid blocking pieces in the grid of the core members or by glueing extra thicknesses of the lower skin material 28 to the underside of the lower skin.

Referring to FIG. 7, element 13 differs from element 11 (FIG. 2) basically in that lower skin 18 may be either covered on the lower side with a suitable material having either a decorative fire proofing or acoustic function or any combination of such functions and that the upper skin 17 has attached to it longitudinal members 29, 30 and 31 laid out to support and give a pitch to any roofing material and also to separate such roofing material from the upper skin 17 to allow a space for ventilation or evaporation of condensation which may form on the underside of such roofing material and to permit the addition of non-rigid insulation material between the upper skin and the roofing material. FIG. 8 shows the application of roofing sheets 32 over such longitudinal members. FIG. 9 shows an alternative construction in which a rigid material 33 which may be an insulating material, is supported on the upper skin 17 and is itself shaped to support and give pitch to a roofing material 34, which may be either a membrane type material or sheets similar to sheets 32. The pitch of the roof may be either that shown in FIG. 8 or that shown in FIG. 9 or any other suitable pitch with the use of either construction, independently of the nature of the element 13. This allows a greater degree of choice in the materials and form chosen for the finished roof than is possible in conventional roof structures where the roof structure is at the same time the support for the finished roof material within the limitations imposed by the dimension 10 in FIG. 1.

The construction of load-bearing panel units 12 shown in FIG. 10 consists of:

A core 35 which in itself usually consists of two vertical edge members 36 and two horizontal edge members 37 framing an inner core 38 to which are bonded two skins 40. In the construction shown, the edge members 37 are made with a slit on their center line into which are bonded four shear resisting plates 39 e.g. by use of an epoxy glue which attaches the panel to elements 11 and 13 as is described later. The depth of edge members 37 is governed by the area of bonding required between the material of the edge members 37 and the plates 39 to resist the forces transmitted through the structure of the unit shown in FIG. 1 and may be e.g. 60 mm. The width of edge members 36 may be approximately equal to the thickness of the core 35 and is governed by the size of any profiling required together with the area of bond to the skins 40 required to maintain the edge members 36 in position when subjected to any forces to which the panel is subject, including forces of thermal or hygroscopic expansion or contraction uplift due to wind.

The material of the edge members 36 and 37 is required to be such that it can transmit the above mentioned forces from the plates 39 to the skins 40, or from one skin to the other skin without fracture, and also that it can be formed or cut with the same degree of accuracy required in the materials for elements 11 and 13, e.g. timber, plywood etc.

The inner core 38 is required to be of a material or combination of materials such that it is capable of resisting the shear forces at right angles to the plane of the panel when subject to loads transverse to the plane of the panel, and have an internal bond and a bond to the two skins such that the panel remains coherent under any forces transmitted through the panel. Apart from these considerations, it may be of any desired combination or configuration of materials as may be required to give required degrees of thermal insulation, thermal capacity or acoustic isolation or acoustic damping e.g. low density fiberboard.

The skins 40 are required to be of any suitable material with the same characteristics of uniformity or near uniformity in strength and stability and the same suitability for being formed or cut to the required degree of accuracy as described above for the skins of elements 11 and 13 e.g. plywood, particle board or hardboard etc. with the further requirement that they be able to resist the stresses in shear, compression and tension imposed in their own plane and the stresses in bending transverse to their plane imposed by the forces in the whole structure when prevented from buckling by their bond to the inner core and the edge members and the ratio of the thickness of the panel to its height 1/50.

FIG. 11 shows an alternative construction where the edge members 36 and 37 are each in two halves with each half bonded to one skin 40 the whole panel being formed by subsequently bonding or fixing one half panel 42 to the other half panel 43. In this case, the inner core 38 is also in two halves bonded to each skin, but may have additional members (shown horizontally at 41, or vertically in 42) of substantially the same material as the edge members 36 and 37, also bonded in two halves to each skin, the purpose of which is to allow the internal bond of the inner core to be effected by bonding or fixing one half of a member 41, or a member 42 to the other when the two halves of the panel are fixed together and also to provide more substantial material for fixing fittings to the face of the panel than may be available with the core material 38.

In the case of this construction, the plates 39 are bonded into position between the two halves of the panel when the two halves are fixed together. The panel resulting from either construction is shown in FIG. 12 consisting of a load-bearing panel 43 with projecting plates 39 by which it may be fixed to elements 11 and 13. In the same way as described above for elements 11 and 13, the characteristics of the panel materials and the characteristics of the panel construction in combination result in an element which has a degree of dimensional accuracy and a dimensional stability, which is particularly suitable for use in the construction of a building unit in which the facility of joining with other similar building units depends on such dimensional accuracy and stability. To give dimensional accuracy to width, each panel is preferably passed within two space cutters e.g. spindle moulders, so that panels of the same nominal width are of a width according to the space between the cutters.

If elements 11, 12 and 13 are each made (with the exception of the core 38 of element 12) of a material with a high strength to weight ratio, such as timber or a timber-based sheet material, then it can be shown that the resulting structure is light in weight compared with conventional construction and therefore may be readily transported without requiring transporting means specially designed to carry heavy loads. The resulting structure is also highly efficient in that the major loads in the structure are those resulting from live loads imposed by use or by natural forces.

In the case of such a relatively lightweight structure, which, because of the limits imposed by dimension 10 (FIG. 1) has a low-pitch roof (e.g. 12° or less), it can be shown that loads on load bearing wall elements consist of vertical compression loads, vertical tension loads, and diagonal tension and compression loads due to horizontal forces causing shear stresses in panels.

In the case of vertical compression loads in one or two story domestic buildings, it can be shown that wall panels constructed as described can comfortably take all loads without the need for any other vertical support element (e.g. a roof unit 3600 mm square — 12 feet square — can be supported on four panels 50 mm thick by 800 mm wide — 2 inches × 8 inches —). For vertical tension loads in such cases, the panels can also comfortably resist all loads, provided that the means by which the projecting plates 39 are fixed to elements 11 and 13 are also designed to resist such loads. For horizontal loads in such circumstances, it can also be shown that the panels can resist all loads (e.g. a wind of 35m/s — 80 mph — blowing on a wall length of 5500 mm — 18 ft — produces a horizontal load which can be resisted by a single panel of 600 mm width — 2 ft — at right angles to the wall) provided that the means by which the projecting plates 39 are fixed to the elements 11 and 13 are also designed to resist such loads.

Thus it can be seen that given that the fixing of the projecting plates is adequately designed there is considerable excess strength in the wall panel elements, which in combination with the ability of the elements 11 and 13 to span their width in either direction produces a considerable freedom of choice in the disposition and size of the wall panels.

We therefore provide a structural system for transportable factory made buildings, a plurality of which are capable of assembly into a co-ordinated cluster of buildings which buildings have sufficient excess strength in a minimum number of elements as to offer a great degree of choice in the number and disposition of wall elements to maxamize user choice in the disposition of those in doors and openings from one building into another in said coordinated cluster.

Figure 15:
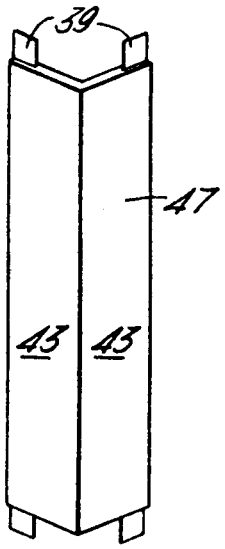
FIG. 15 shows a corner panel according to the invention.
Figure 15A:
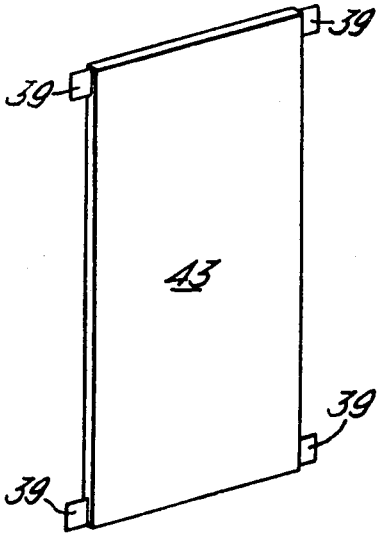

FIG. 13 shows a similar panel 43 which is made with an opening 44 into which a window unit can be inserted. FIG. 14 shows a further panel unit with an opening 44 framed by the panel edge members 36 (FIG. 10) and a sill member 45 which is fixed to element 11 by means of screws at positions 46. FIG. 15*a* shows a panel 43 with projecting plates 39 extending from the side rather than the top of the panel; the plates could also be T shaped rather than rectangular as shown in FIGS. 10 to 16 and 15*a* and 16*a*. FIG. 16*a* shows a panel 43 having a door opening and having U shaped brackets 37*a* to engage adjacent panels to hold the panel in position. FIG. 15 shows two panels similar to panel 43 but bonded edge to edge at 47 preferably at the factory to form an L-shaped or corner panel for use at exterior corners, the purpose of which is to avoid the problem of weather proofing exterior angle joints, and to assist in aligning element 13 correctly above element 11 when assembling units.

Figure 16:
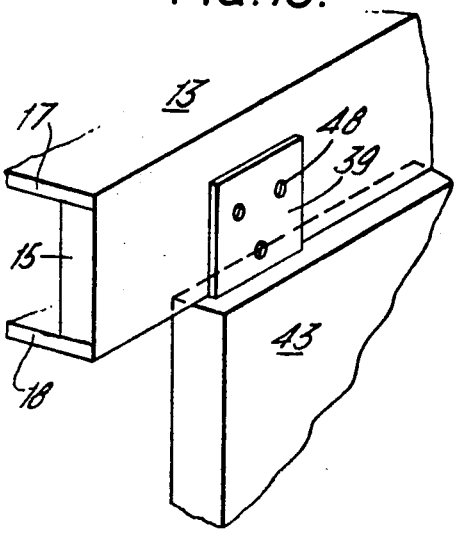
FIG. 16 shows details of fixing a wall panel to to a roof panel.
Figure 16A:
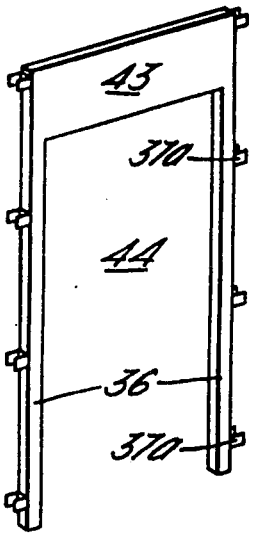

FIG. 16 shows a part of element 13, with edge member 15, top skin 17 and bottom skin 18, to which a wall panel 43 is attached by screws 48 through plate 39. This shows that element 13 bears on only half the thickness of panel 43 and that plate 39, being positioned on the center line of panel 43, aligns the panel in relation to element 13 when fastened. This construction is used for the majority of panel fastenings for the panels described above, subject to vertical loads in compression or tension.

Figure 17:
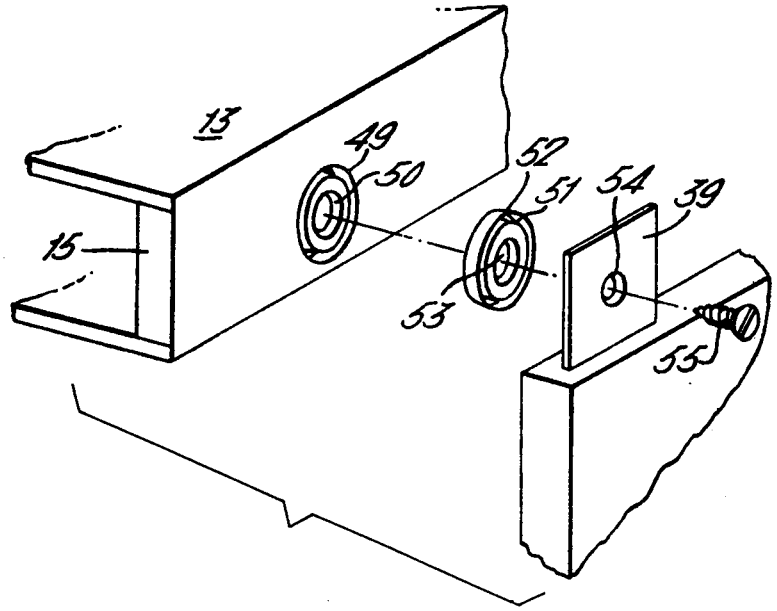
FIG. 17 to FIG. 20 show alternative fixing methods.
Figure 18:
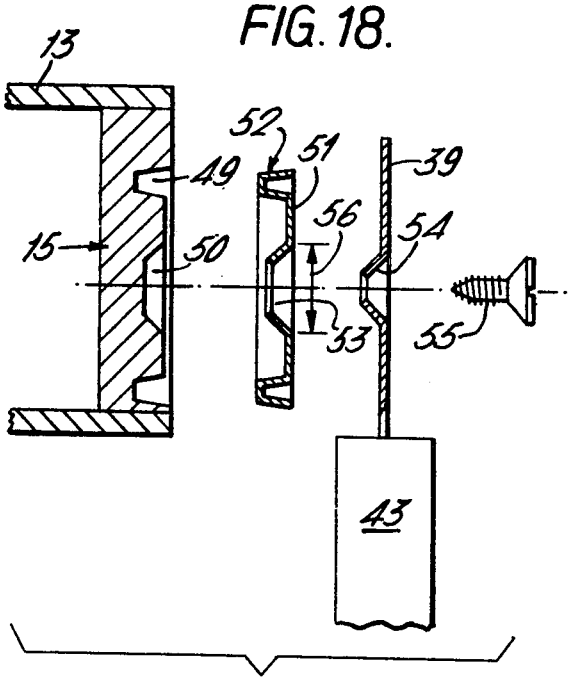
Figure 19:
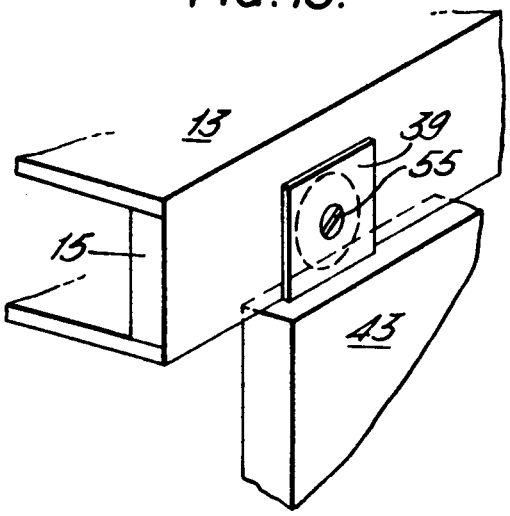

With respect to FIGS. 18 and 17, it is more convenient to select certain panels to take horizontal forces than to make every panel capable of taking all types of loads. Hence, certain panels have a specially adapted connection designed to transmit diagonal loads due to shear to elements 13 and 11. As shown in FIGS. 18 and 17, edge member 15 in element 13 has cut into its exterior surface an annular groove 49 with a circular sinking 50 concentric to it. Into this fits a stamped or cast steel plate 51 with an annular flange 52 and a circular recess 53 which are adapted to fit exactly into the groove and sinking in the edge member. Plate 39 has a punched countersinking 54 concentric on a hole sized to fit exactly around the shank of a countersunk screw 55. In use, the annular groove and sinking are formed with a drill-mounted tool, and the shear plate 51 pushed into it. In order to transmit shear to the material of the edge member, the correlation of the flange on the plate and the annular groove must be exact. Plate 39 is offered up to plate 51, and the countersunk hole used as a guide to drill a hole through the recessed portion of plate 51 and into the edge member 15. Screw 55 is then inserted so that its flange transmits shear forces from plate 30 to plate 51. By this means as shown in the complete construction in FIG. 19, the screw head does not project beyond the face of the plate 39 and the screw hole in plate 39 does not need to be aligned exactly with any point on the plate 51, having the area of the recess (56 in FIG. 18) in which alignment can be made in any direction, the drilling on site enabling dimensional variations to be overcome.

Figure 20:
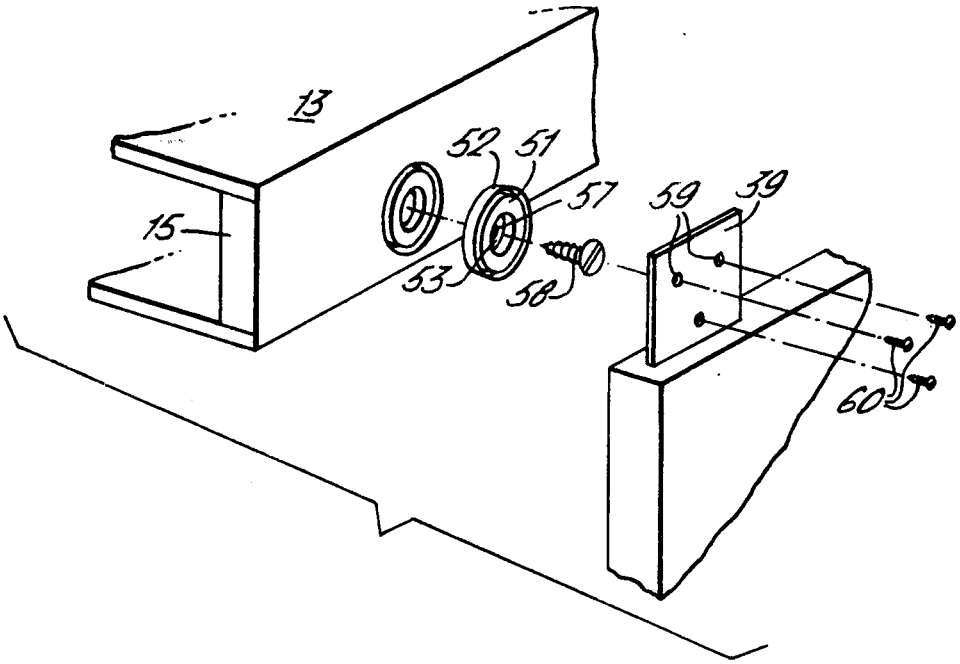

In a further variation (FIG. 20), the shear plate 51 has a concentric hole 57 through which a panhead woodscrew 58 is inserted to hold the plate into edge member 15, the recess 53 being deep enough to take the thickness of the head of the screw 58. Plate 39 has three countersunk holes 59 drilled in it, through which self-drilling and tapping metal screws 60 are inserted to fasten plate 39 to the outer portion of plate 51. In this way, the screw holes in plate 39 may be made identical in the construction shown in FIG. 20 to that shown in FIG. 16 and hence any panel may be used as a shear-resisting panel, without having a specially adapted plate connection.

Figure 21:
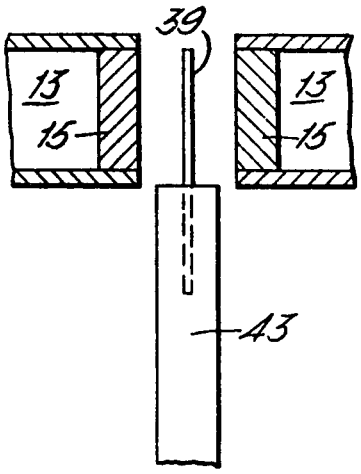
FIG. 21 to FIG. 24 show assemblies of floor and roof units with wall panels.

Referring to FIG. 21, plate 39 may be attached to either of the roof elements 13. The result of the arrangement is that panel 43 not only shares the vertical compression load of both panels and shares other loads by means shown later in FIG. 25, but also is placed on center line of junction of elements 13 and 11, as shown in FIG. 23 with relation to floor units the advantage of which is described later.

Figure 22:
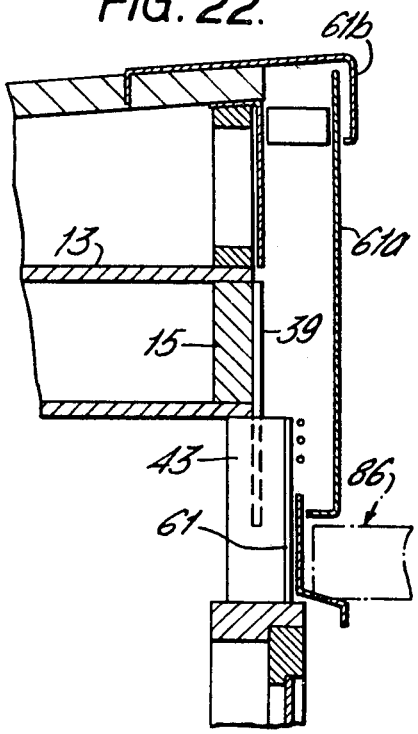

In FIG. 22, panel 43 with exterior weather-resistant surface 61 similarly placed, the joint concealed and protected by fascia/wiring duct referred to later.

Figure 23:
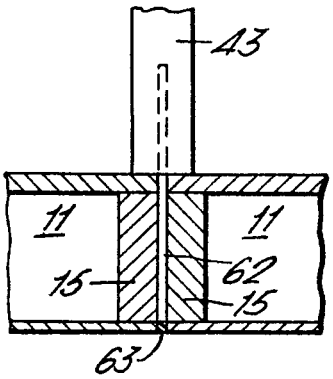

FIG. 23 with the assembly completed, shows that the gap between units 11 is the width of plate 39 (e.g. 3mm — $\frac{1}{8}$ inch: to say 10mm — $\frac{3}{8}$ inch) and is sealed with a compressible seal at 63, so the joint is sealed top and bottom. A similar seal is provided with units 13.

Figure 24:
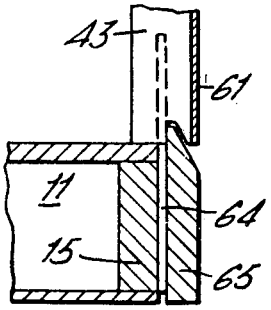

Referring to FIG. 24 exterior panel 43 may be specially rebated at the bottom, or otherwise profiled to provide a lap junction with floor edge cover 65, leaving drained joint space 64 of same dimension as 62 in FIG. 23.

The effect is that the assembly shown in FIG. 22 may be turned into assembly shown at FIGS. 21 and 23 by removing exterior panels (it is desirable not to use exterior finish in an interior situation) and replacing with interior panels and attaching adjacent units 11 and 13; however it can be seen that it is possible to simply use an exterior panel as an interior panel: hence adaptation involved in making additions, or removing units is minimal.

Figure 25:
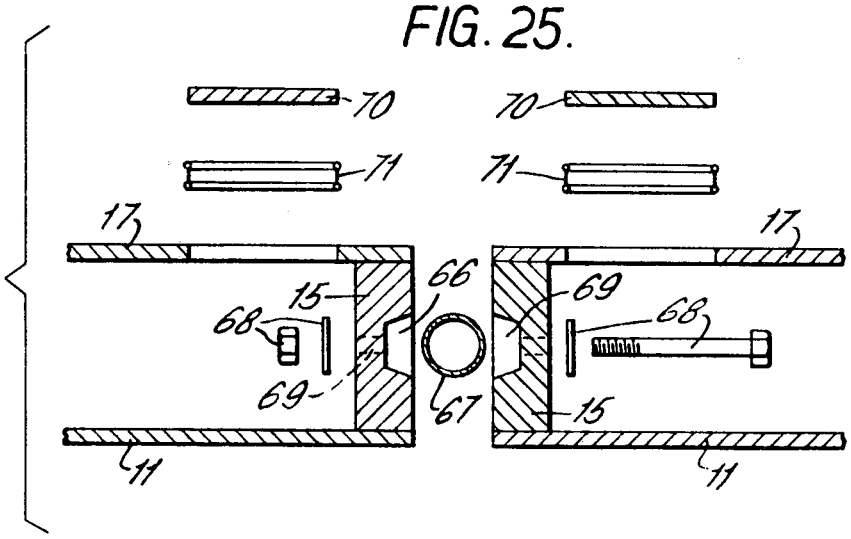
FIG. 25 is an exploded section and FIG. 26 shows the elements of FIG. 25 assembled to show a shear resisting joint between adjacent floor or roof units.
Figure 26:
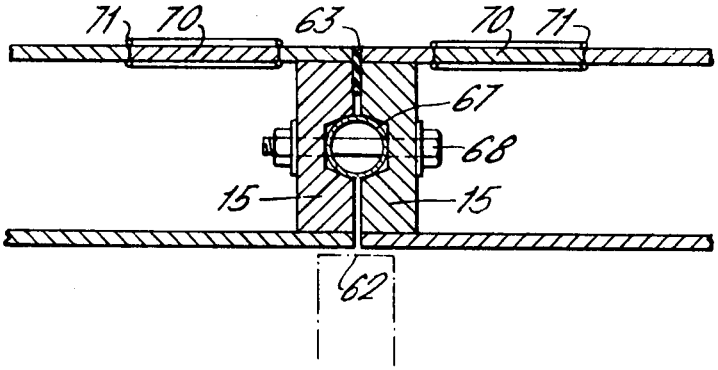
Figure 27:
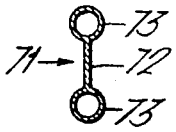
FIG. 27 is a cross section of a hand hole seal.

Referring to FIGS. 25 and 26, although it is not always necessary in some circumstances, such as where the units being joined are longer than the designed span of the units, two units may be required to be joined edge to edge in a manner which make them act together structurally so that e.g. shear forces or vertical tension may be transmitted from one unit 11 or 13 to the adjacent unit to which is attached a panel 43. One such device is shown to provide a shear key between units. Edge member 15 is grooved where required with sinking 66 with shoulders sloped to provide tangential contact with steel pipe 67. Units are brought together so that the four tangential surfaces bear (with slight crushing) on the pipe by pulling together through or adjacent to the pipe by a bolt, nut and washer assembly 68 passing through hole 69 in edge 15. Access to the bolt assembly for insertion and tightening is gained by removing disc 70 from skin 17 and reinserting as shown in FIG. 26, sealed with an annular ring of neoprene, the profile of which is shown in FIG. 27 consisting of web 72, with hollow tubes 73. The result is shown in FIG. 26 with units both bearing on shear key 67, but leaving gap 62 (refer FIG. 23) which is sealed at 63.

Alternatively, where it is preferred not to remove access discs, the units may be pushed together to bear on key 67, and then held in contact by "nailplates" or spiked timber connectors fastened over the joint on the side opposite to the wall panel.

The structure is now complete and it can be seen that the total assembly of elements 11, 12 and 13 with the correct disposition of wall panels 12 provides in effect a box-girder construction. This makes the whole building unit particularly rigid and particularly suitable for transport even when as shown in FIG. 27, the transported unit consists of more than one unit, joined as shown in FIGS. 23 and 26 at 74 in FIG. 27A.

The wall panels being fixed to floor and roof panels in tension and shear act to evenly distribute vertical loads between the floor slab and the roof slab edges. Thus, as shown in FIG. 28, when one transportable unit 75 is erected on top of another 76 to make a two story building and the lower unit 76 is supported on piles 77 originally spaced for the maximum spans of the floor element of unit 77, it can be seen that the extra vertical load imposed by unit 75, and its occupancy, on the wall panels of unit 76 would cause excessive bending in the edge of the lowest floor between piles. However the connection of the wall panels shares this excess load between the roof and floor elements of unit 76, so that the bending stress in the lowest floor edge is effectively halved.

It is clearly desirable that the edges of two floor or roof elements when joined edge to edge be accurately aligned in the vertical direction. It can be seen that for two floor units, positioned on adjacent foundations, this is, in the first place, dependent on the foundations themselves being at the same level. However, between foundation supports, one floor unit may be deformed upwards, while the adjacent floor unit is deformed downwards (for various reasons such as one already being under load, while the other has warped up when the upper skin has a greater moisture content than the lower skin). Where a panel is inserted at the joint, as in FIG. 23, this clearly serves to align the two adjacent floors by reason of it spanning across the edges of both. Where this is insufficient, the floor panel to which the wall panel is not attached has warped downwards, while the roof panel remains level, or there is no wall panel, then the shear key shown in FIG. 26 serves to align the floor units 11, or roof units 13. The geometry of the joint depends on considerations of modular panel jointing initially.

The wall-panel-to-floor/roof joint just described has modular design restraint as a major factor in its geometry. Interior panel fixing to floor/ceiling and interior door frames are dependent on geometry. The wall panel joints are used for access and an exterior duct **61*a* (FIG. 22) is provided, the cover of which acts as a cover 61*b* to joint shown in FIG. 22** covers the edge of the roof space between the top of the roof slab and the roof covering and provides at the lower edge an overflashing for awnings, window heads for awnings, window heads and link roofs. Unit-to-unit combinations are conditioned by roof pitch and use of a link under edge of wiring duct cover both to provide flashing and to enable wiring duct to run through uninterrupted. Complete essentials of system show now that it now can extend or shrink horizontally or vertically with freedom of arrangement of a unit largely determined by freedom with which panels can be re-positioned and units joined in a number of configurations.

Figure 30:
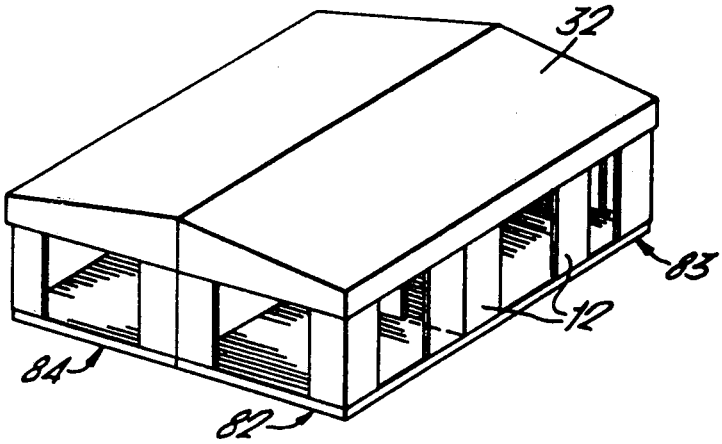
Figure 31:
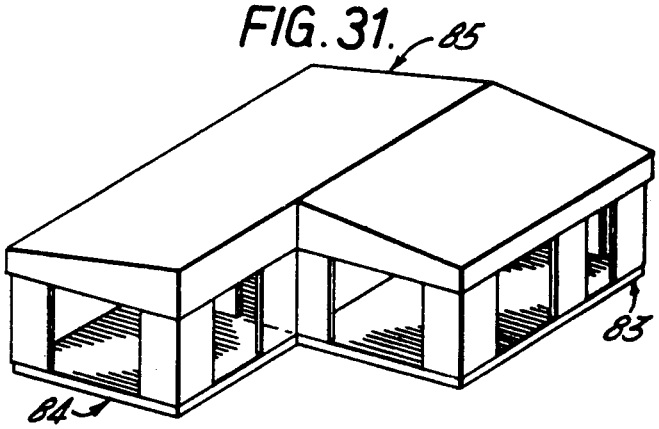
Figure 32:
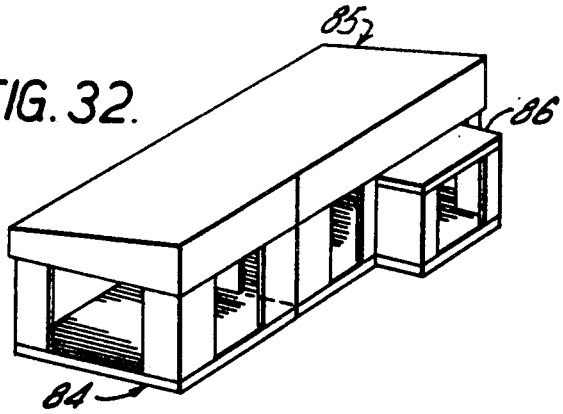
Figure 33:
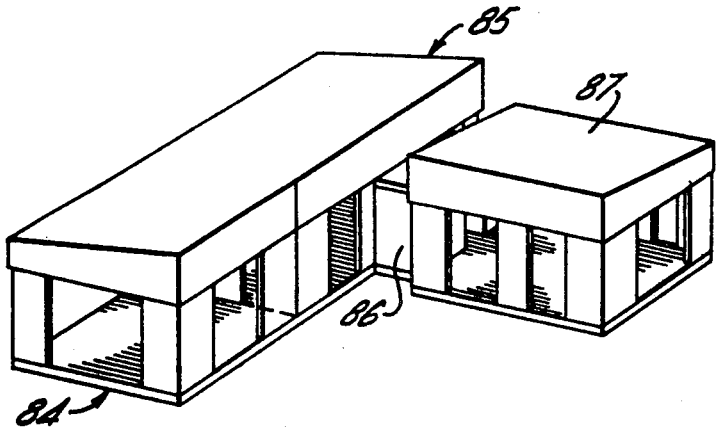

In FIG. 29, buildings 82 and 83 are shown assembled in end to end relationship; in FIGS. 30 and 31, buildings 82, 85, 84 and 83 are shown in end to end and side to side relationship. In FIG. 32, a link building 86 having a height less than height 6 (FIG. 1) is shown added to building 85 and in FIG. 33 the same buildings 84 and 85 are shown with the link 86 connecting the unit 85 to a further unit 87. This illustrates, if only briefly the versatility of the construction. The invention has other provisions for variations however. Thus the panels are designed to modular considerations.

Figure 34:
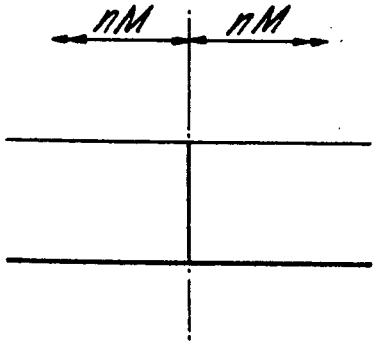
FIG. 34 to FIG. 38 show design criteria in relation to modular panels for use in the invention.
Figure 35:
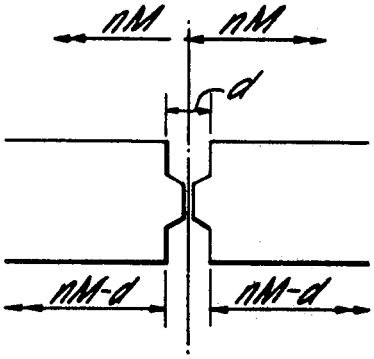

Modular construction effectively means that there is a grid of lines spaced one module (M) part, to which all components relate. Hence any component is of the dimensions nM (FIG. 34) where *n* is any whole number. Theoretically then the interface of the joint between any two components falls precisely on the module line. In practice, assuming a horizontal component related to a horizontal grid (e.g. a floor panel) there is a joint space at the interface, either to provide means of joining the two components or to seal the joint or to allow for tolerance in their manufacture or usually all three. Hence, in fact the edge of any component is designed to have a constant relationship to the module line by being kept a distance *d* (FIG. 35) from the modular line. Therefore the dimension of the component is not *n*M, but *n*M-*d*.

Figure 36:
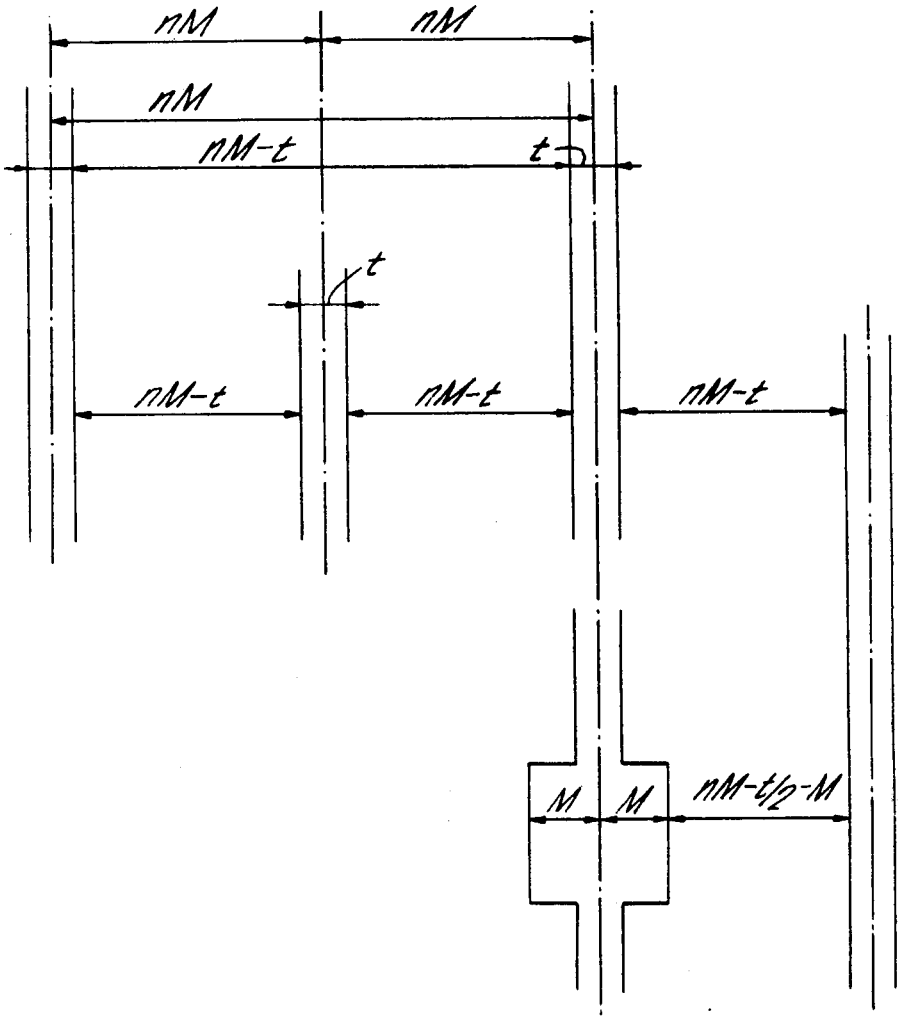

Again in practice and again assuming a horizontal grid, but considering any component at right angles to the plane of this grid (e.g. a wall panel on a floor) the wall panel must have a thickness *t*. Hence, the wall panel must be centered on the module line so that its face is *t*/2 distance from the module. Hence, any other wall panel intersecting the first at right angles has a maximum dimension on its faces not of *n*M but of *n*M − *t*, (FIG. 36).

Now in most systems of construction, the wall elements are required to be fully supported on the floor elements; hence, if the wall is at the outside edge of a floor panel and centered on the module line then the floor panel must in this case have a dimension of *n*M-*d* plus *t*/2 i.e. it does not have a constant relationship to the module. Again in most systems of construction, supporting elements (e.g. columns) are required which are of greater dimension than the wall thickness *t*. Hence, if the column dimension is for instance 2M, then any wall panel or other modular component (e.g. ≧ fitting or a window) which intersects a line of wall panels with columns has either a dimension of *n*M − *t* or a dimension of *n*M − *t*/2—M i.e. it does not have a constant relationship to the module.

This is overcome in correct modular design by designating zones which may be modular or non-modular interruptions to the grid or impositions on the grid. This does not solve the problem but provides a means of noting it so that it can be allowed for but these methods have these advantages.

Figure 37:
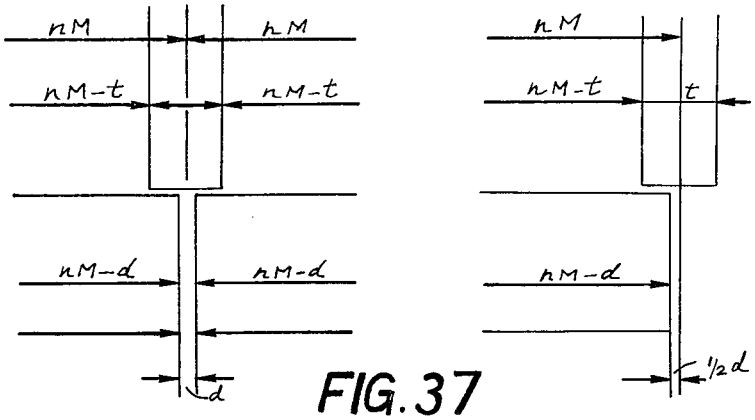

It is therefore advantageous if the number of sizes of modular components is kept to a minimum. The present construction system has been devised in which considering a horizontal modular grid all components have a constant relationship to the module : eg floor panels all being *n*M − *d*, and wall components all being at least *n*M − *t* (FIG. 37). In fact for the case of making joint connections between wall panels, and to allow access for wiring, the joint width has been taken as 2T so that all wall panels have a face dimension of *n*M − 2*t* (FIG. 38).

Figure 38:
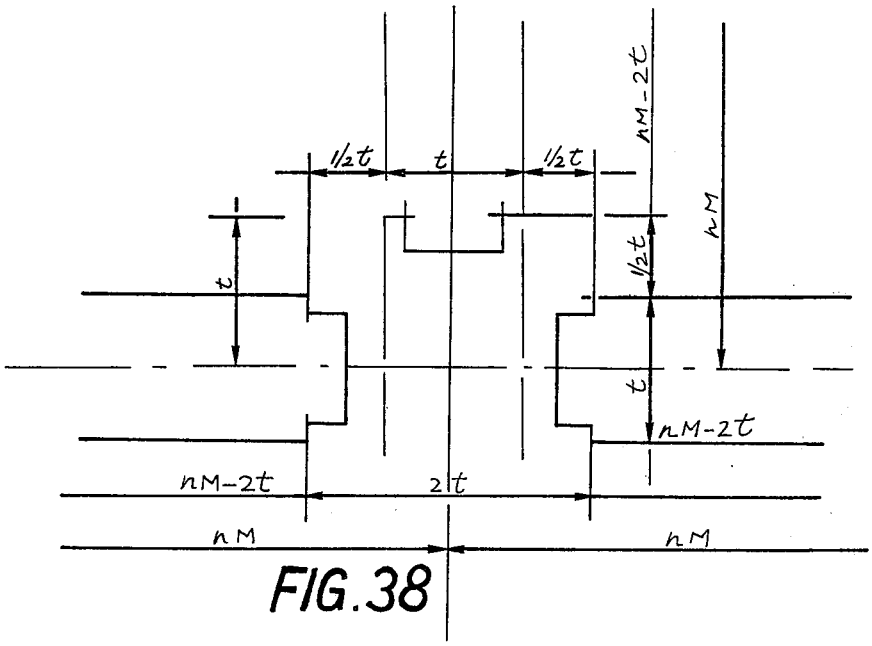

Thus because of the joint width considerations shown in FIG. 38 where the space W between panel ends is wide enough to allow the thickness T of a panel to slide between two adjacent panels, panels may be readily removed and for example, a panel such as the panel 43 FIG. 12 may be replaced by a window panel shown in FIG. 13 or door panel shown in FIG. 16*a*. The panel joints may of course be covered with molding.

Figure 39:
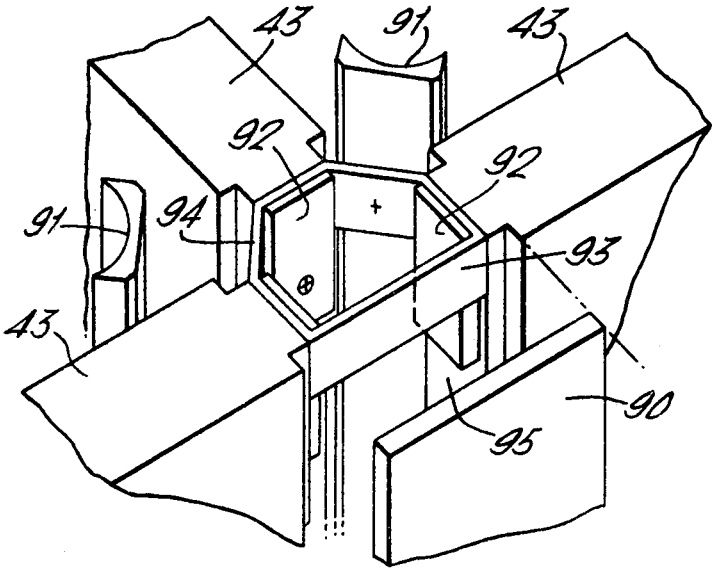
FIG. 39 is a perspective sketch of one form of wall panel joint.
Figure 40:
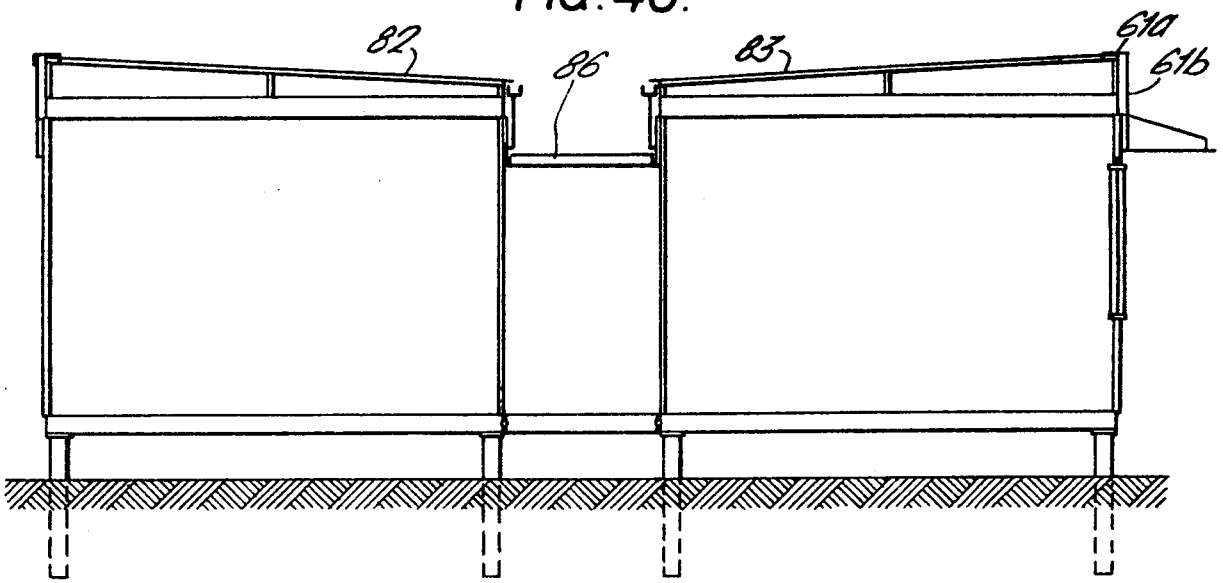
FIG. 40 is a cross section of a three building cluster including a link.

The open spaces in the joint provides spaces for wiring plumbing or the like services. Connections between panels may comprise brackets 92 (FIG. 39) fixed to edges of panels 43 at spaced intervals and collars 93 fixed in spaces 94 between the panel faces 95 and the parts of the brackets 92.

From the foregoing it will be seen that a building may be provided using prefabricated panels which is simple to manufacture and which provides many advantages.

Considerable savings are made in the use of labour materials under controlled conditions in the factory and a minimum amount of site work is required. This method of construction offers the further advantage in that one wall panel may be removed from the building without disturbing wall panels and thus additions or in fact subtractions from the building may be made readily depending on the requirements of the occupier of the building. For example, bedrooms may be added to a basic house as a family grows and at a later date one or more of these may be removed and sold for use elsewhere without the need for major reconstruction.

It is a feature of the invention that because the joints between the panels are quickly and readily removed and panels themselves are equally quickly removed (albeit it being necessary in some circumstances to cut the stress brackets 39 if a stressed panel is to be removed). The versatility of the construction is extremely great, and thus rooms may be enlarged simply by removing panels, extensions may be made by adding units, with the linking unit giving maximum flexibility in this regard and the construction may be regarded "as the house that grows". The main point is that the customer has tremendous freedom of choice.

I claim:

1. A building cluster comprising a plurality of building units, each said building unit forming at least one room at least when connected to one or more adjacent building units, each said building unit being of a width and length selected from a plurality of a modular unit dimension, said plurality of a modular unit dimension being arranged in two directions as a horizontal modular grid, each said building units being arranged to be joined together to form said building cluster so that the center line of any joint between said building units coincides with any selected grid line of said modular grid and so that any wall between any two adjacent said rooms formed by any two adjacent said building units is a wall common to both said building units, and is further arranged so that the center line of said wall coincides with the center line of any said joint between said building units and with said selected line of said modular grid, each said building unit being constructed separately from any other building unit in said building cluster and comprising a stressed skin floor member and a stressed skin roof member both the same length and width, and a plurality of wall panel members on at least two sides of said separately constructed building unit, said wall panel members being disposed between said floor member and said roof member and removably connected thereto by means of lug members inserted on the center line of the top and bottom edges of said wall panel members, and removably connected to the edges of said floor member and said roof member in which at least some of which removable connections of said lugs to the edges of said floor members and said roof members are adapted to resist shear forces due to side sway or lozenging forces on said building unit without changing the configuration of said wall panel members, said wall panel members being spaced apart from and connected to each other in their vertical edges by means of removable spacing members such that at the connection of at least two said wall panel members a continuous cavity is formed the least dimension of which is at least concident with the thickness of any said wall panel member arranged to enable changes selected from removal and addition of any said wall panel member without disturbing any other said wall panel member in the building unit and without disturbing any electrical wires in the cavity, the relationship of the edges of said floor members and said roof members and said wall panel members to said modular grid being such that where $M$ represents said modular unit dimension and $n$ represents any whole number and $nM$ represents any plurality of said modular unit dimension, and where $d$ represents the spaced distance apart of the edges of any two adjacent said floor members or the edges of any two adjacent roof members and coincides with the thickness of any one said lug, $t$ represents the thickness of any one said wall panel member, and is always greater than $d$, then any said floor member and any said roof member has a length or width of $nM-d$, and any said wall panel member has a width of no greater than $nM-t$ and no less than $nM-2t$ so that any said floor member or any said roof member or any said wall panel members has a fixed relationship of its vertical edges to said modular grid regardless of the plurality of modular unit dimensions selected for its horizontal dimensions, and so that the intersection of the center lines of at least three said wall panel members, when one said wall panel members is at right angles to the other two said wall panel members, will concide with the center line of the joint between at least two building units and with the intersection of the lines of said horizontal modular grid with the vertical edges of these panels a fixed distance away from said intersection so that such vertical edges define a space between the panels.

2. A building cluster as claimed in claim 1 wherein each said stressed skin roof or floor unit comprises a core and a pair of continuous skins, one skin being fixed to each side of said core, said core comprising a plurality of strips of suitable material placed so that the edges of each strip are fixed one to each skin and said strips are arranged in two sets, each strip in each set being substantially parallel with the next strip in the set and each set being arranged to lie at a suitable angle to said other set, the angle of one set with the other set being such that one set retains the other set substantially normal to the skin of the panel before and during fixing of the skin to the core.

3. A building cluster as claimed in claim 2 wherein said structural panel has said skins fixed to each of said strips with a suitable adhesive and the core strips have a minimum thickness to spacing ratio of 1:50 and a maximum thickness to height ratio determined by the allowable shear stress of the material used.

4. A building cluster as claimed in claim 2 wherein said structural panels are provided with side and end frame members.

5. A building cluster as claimed in claim 4 wherein said side and end frame members are of suitable thickness, at least some of which have a groove longitudinal of the outer face and said connecting means comprising a key member arranged to engage in a pair of opposed grooves one on each adjacent panel, side or end member and a bolt joining the side members with said key members sandwiched therebetween to fix adjacent panels one to the other, the construction and arrangement being such that said key member forms a spacing member which is clamped within said opposed grooves against both sides and the bottom of said grooves and spaces the side or end members of adjacent panels a suitable distance from each other relative to the modular grid.

6. A building as claimed in claim 1 wherein the fixing between a wall panel and a floor or roof unit is provided by a bracket fixed to the wall panel, a disc member having a cylinder fixed thereto the cylinder fitting in a depression in an edge of a floor panel and fixing means fixing said bracket to said disc member and fixing said disc member to said floor or roof unit.

7. A building cluster as claimed in claim 1 wherein joints between adjacent panels comprise tongues fixed to and extend parallel to the vertical edge of the panels and collars having members adapted to be retained between an edge member of a panel and said tongue holding said panel members together at a spaced distance apart relative to the modular grid line.

8. A building cluster as claimed in claim 1 wherein at least one rigid joint cover is removably fixed relative to said joint for permitting access to a joint cavity which can accommodate utility conduits.

9. A building as claimed in claim 8 wherein said joint covers fit in rebates in said panel edges.

10. A building as claimed in claim 9 wherein a water shedding structure is mounted above the upper stressed skin unit.

11. A building as claimed in claim 10 wherein a wiring duct is provided along at least one exterior wall of the building permitting wires to be introduced to within the building through spaces between panels.

* * * * *